US010597597B1

(12) United States Patent
Abdallah et al.

(10) Patent No.: US 10,597,597 B1
(45) Date of Patent: Mar. 24, 2020

(54) FUEL HIGH TEMPERATURE ANTIOXIDANT ADDITIVE

(71) Applicant: ExxonMobil Research and Engineering Company, Annandale, NJ (US)

(72) Inventors: David J. Abdallah, Moorestown, NJ (US); Zsolt Lengyel, Newtown, PA (US); Mike T. Noorman, Doylestown, PA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

(21) Appl. No.: 16/128,615

(22) Filed: Sep. 12, 2018

(51) Int. Cl.
*C10L 1/232* (2006.01)
*C10L 10/00* (2006.01)

(52) U.S. Cl.
CPC ..... *C10L 1/232* (2013.01); *C10L 10/00* (2013.01); *C10L 2200/043* (2013.01); *C10L 2200/0423* (2013.01); *C10L 2200/0446* (2013.01); *C10L 2200/0469* (2013.01); *C10L 2230/081* (2013.01); *C10L 2270/023* (2013.01); *C10L 2270/026* (2013.01); *C10L 2270/04* (2013.01)

(58) Field of Classification Search
CPC ..... C10L 10/02; C10L 10/12; C10L 1/143; C10L 1/1641; C10L 1/22; C10L 1/23; C10L 1/231; C10L 1/232; C10L 1/2383; C10L 10/00; C10L 2200/0469; C10L 2200/043; C10L 2200/0446; C10L 2200/0423; C10L 2270/023; C10L 2270/026; C10L 2270/04
See application file for complete search history.

(56) References Cited

U.S. PATENT DOCUMENTS 4,398,505 A * 8/1983 Cahill ..... C10L 1/232 123/1 A
4,670,131 A 6/1987 Ferrell
(Continued)

FOREIGN PATENT DOCUMENTS

WO WO-0042133 A1 * 7/2000 ..... C10L 1/19

OTHER PUBLICATIONS

Lacey et al., "A Laboratory-Scale Test to Predict Intake Valve Deposits", SAE Technical Paper 972838, 1997, pp. 239-250.
(Continued)

*Primary Examiner* — Latosha Hines
(74) *Attorney, Agent, or Firm* — Robert A. Migliorini

(57) ABSTRACT

High temperature antioxidant additives and methods that improve a liquid fuel composition's thermal oxidative stability are disclosed. A liquid fuel composition may comprise a liquid fuel; and a high temperature antioxidant additive comprising a nitroxide radical having a formula:

wherein $R_1$, $R_2$, $R_3$, and $R_4$ are individually selected from an alkyl group or a hetero atom substituted alkyl group, and wherein $R_5$ and $R_6$ are any atom or group except hydrogen which can bond covalently to carbon.

15 Claims, 9 Drawing Sheets

(56) References Cited

U.S. PATENT DOCUMENTS

| | | | | |
|---|---|---|---|---|
| 5,460,634 | A * | 10/1995 | Fava | C10L 1/143 44/329 |
| 5,711,767 | A * | 1/1998 | Gande | C10L 1/14 44/423 |
| 6,210,452 | B1 | 4/2001 | Su | |
| 6,323,175 | B1 | 11/2001 | Hsia | |
| 7,910,607 | B2 | 3/2011 | Ba et al. | |
| 2004/0216370 | A1* | 11/2004 | Gande | C10L 1/14 44/322 |
| 2005/0028435 | A1* | 2/2005 | Pace | C10L 1/023 44/451 |
| 2007/0204505 | A1* | 9/2007 | Abou-Nemeh | C10L 1/14 44/333 |
| 2008/0028674 | A1 | 2/2008 | Jackson et al. | |
| 2010/0293844 | A1* | 11/2010 | MacMillan | C10L 1/221 44/419 |
| 2011/0154724 | A1* | 6/2011 | Martyak | C10L 1/14 44/307 |

OTHER PUBLICATIONS

The International Search Report and Written Opinion of PCT/US2019/046725 dated Nov. 7, 2019.

* cited by examiner

FUEL HIGH TEMPERATURE ANTIOXIDANT ADDITIVE

FIELD

This application relates to high temperature antioxidant additives for liquid fuels, and, more particularly, embodiments relate to high temperature antioxidant additives and methods that improve a liquid fuel's thermal oxidative stability.

BACKGROUND

Operation of an internal combustion engine can lead to deposits in the fuel system. The deposits can adversely impact engine performance, potentially resulting in fuel system component malfunction or failure. For instance, the deposits can restrict the flow of air and fuel entering the combustion chamber, which can cause stalling and hesitation. One contributor to fuel system deposits is fuel oxidation, caused by reactions between molecular oxygen and the fuel. This process is accelerated with higher temperatures. To achieve better combustion and reduced emissions, modern engine designs have trended toward higher fuel system operating temperatures and pressures, thus subjecting fuels to higher thermal loads than has been typical in the past. However, the increased thermal loads can lead to increased fuel oxidation and, thus, increased deposits.

One technique that has been used for fuel-system deposit control has been to use detergents. However, detergents typically do not work across the entire fuel system and may be designed to target specific components within the fuel system, e.g., carburetor detergents, intake valve detergents, valve stem deposit fluidizers, and direct injector detergents, among others. In some instances, a detergent targeting a specific component can cause deposits in other components of the fuel system. For instance, high levels of carburetor detergents can increase piston ring belt deposits and intake valve deposits, while intake valve detergents that can clean the tops of valve tulips can create sticky valve stem deposits. Additionally, these detergents and the fluidizers that often accompany them are typically not conducive to combusting and tend to contribute to combustion chamber deposits, which are known to lead to octane rating increase, combustion chamber deposit interference, disturbance of the air-fuel mixture formation, and/or increased regulated emissions. In addition, while detergents are designed to address the deposits that can result from oxidation, they are not designed to stop oxidation from occurring. While antioxidant additives have been included in fuels, they are designed to combat oxidation and preserve fuel stability at ambient storage conditions rather than engine operating temperatures. At increased temperatures, these antioxidants can degrade and lead to fuel system deposits.

SUMMARY

Disclosed herein is an example liquid fuel composition. The example liquid fuel composition may comprise a liquid fuel; and a high temperature antioxidant additive comprising a nitroxide radical of the following Formula (1):

(1)

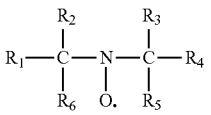

wherein $R_1$, $R_2$, $R_3$, and $R_4$ are individually selected from an alkyl group or a hetero atom substituted alkyl group, and wherein $R_5$ and $R_6$ are any atom or group except hydrogen which can bond covalently to carbon.

Further disclosed herein is another example liquid fuel composition. The example liquid fuel composition may comprise a liquid fuel in an amount of about 98 vol. % or greater; and a nitroxide radical in an amount ranging from about 1 ppm to about 100 ppm and having the following Formula (2):

(2)

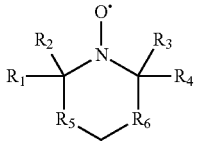

Further disclosed herein is a method for improving thermal oxidative stability of a liquid fuel. An example method may comprise including an antioxidant additive comprising nitroxide radical in the liquid fuel, wherein the nitroxide radical is of Formula (1).

BRIEF DESCRIPTION OF THE DRAWINGS

These drawings illustrate certain aspects of the present invention and should not be used to limit or define the invention.

DETAILED DESCRIPTION

This application relates to high temperature antioxidant additives for liquid fuels, and, more particularly, embodiments relate to high temperature antioxidant additives and methods that improve a liquid fuel composition's thermal oxidative stability. As used herein, the antioxidant additives are referred to as "high temperature" antioxidant additives because the antioxidant additives improve a liquid fuel composition's thermal oxidative stability. Embodiments disclose an antioxidant additive that includes a nitroxide radical to improve the thermal oxidative stability of a liquid fuel composition. Thermal oxidative stability is measured in terms of the liquid fuel composition's tendency to form deposits in the fuel system, including fuel lines, heat exchangers and nozzles of jet engines as well as on the intake valves, ports, fuel injectors, and combustion chamber surfaces of gasoline and diesel engines. By operation improvement of the thermal oxidative stability, the antioxidant additives may not only help with fuel storage stability but also provide benefits to the liquid fuel composition at engine operating temperatures.

Figure 1:
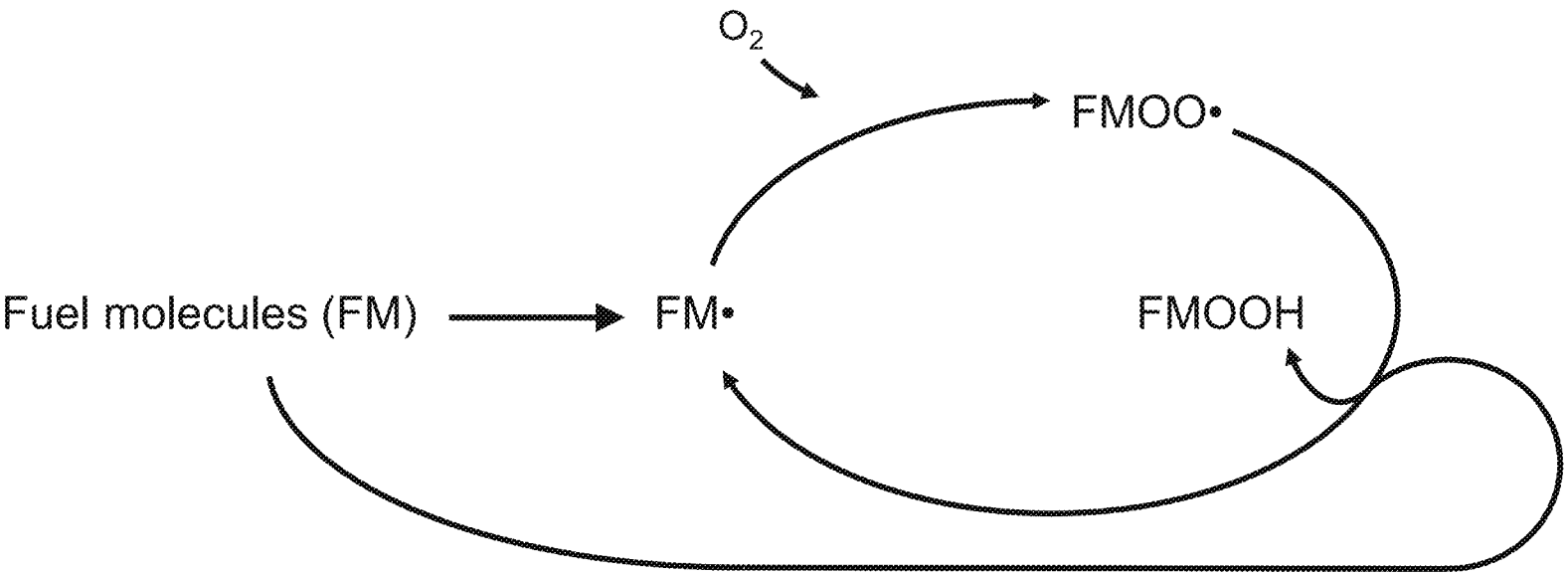
FIG. 1 illustrates an autoxidative free radical chain reaction process for a fuel oxidative degradation.

During heating of liquid fuel composition, for example, in operation of an engine, fuel oxidative degradation proceeds through an autoxidative free radical chain reaction process. An example reaction scheme 100 for fuel oxidative degradation is provided in FIG. 1. The fuel molecules (shown as FM) present in the liquid fuel composition break down into free radicals (shown as FM.). Propagation reactions may then occur in which the free radicals combine with oxygen to form peroxide radicals (shown as FMOO.) which abstract hydrogen from another fuel molecule, or within the same fuel molecule, to form a new FM. and a hydroperoxide. Termination reactions may then occur in which the peroxide radicals are eliminated. The termination reactions include reaction of the peroxide radicals with additional fuel molecule radicals to form peroxides. Hydroperoxides formed from the chain reaction are inherently unstable to heat and can readily decompose to yield additional free radicals (e.g., FM. and OH.), which continue to initiate additional chain reactions and additional hydroperoxides (shown as FMOOH). Hydroperoxides are a primary product of autoxidation and therefore may be considered the main initiators in thermal oxidation. Hydroperoxides, and their decomposition products are ultimately responsible for the changes in molecular structure and fuel system deposits. Conventional antioxidants produce hydroperoxides that stop the chain reaction at storage temperatures but can decompose to produce free radicals when heated. However, the high temperature antioxidant additive disclosed herein comprising the nitroxide radical should delay the oxidation induction period of the liquid fuel composition. As the oxidation induction period is delayed less peroxide radicals are generated, leading to less hydroperoxides and ultimately less deposits. In other words, the antioxidant additive may be considered to block fuel degradation pathways at high temperatures.

There may be several potential advantages to the compositions and methods disclosed herein, only some of which may be alluded to in the present disclosure. One of the many potential advantages of the compositions and methods is that the nitroxide radical should extend the oxidation induction period of the liquid fuel composition. The oxidation induction period is an initial slow stage of fuel oxidation after which the oxidation reaction accelerates. By extending the oxidation induction period, fuel oxidation in the fuel system that leads to deposits may be reduced or potentially avoided. In some embodiments, the oxidation induction period may be extended to a timeframe that is longer than the liquid fuel composition will spend at elevated temperatures in the fuel system components.

As used herein, the term "nitroxide radical" refers to stable nitroxide free radicals. Nitroxide radicals may have either a heterocyclic or linear structure. Suitable nitroxide radicals may include, but are not limited to, a nitroxide radical of Formula (1) as follows:

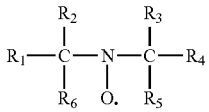

(1)

wherein $R_1$, $R_2$, $R_3$, and $R_4$ are individually selected from alkyl groups or hetero atom substituted alkyl. The alkyl (or heteroatom substituted) groups $R_1$, $R_2$, $R_3$, and $R_4$ may be the same or different and, in some embodiments, include 1 carbon atom to 15 carbon atoms. In some embodiments, $R_1$, $R_2$, $R_3$, and $R_4$ are individually selected from methyl, ethyl, or propyl groups.

The remaining valences ($R_5$ and $R_6$) in the formula above may be satisfied by any atom or group except hydrogen which can bond covalently to carbon, although some groups may reduce the stabilizing power of the nitroxide structure and are undesirable. In some embodiments, $R_5$ and $R_6$ are individually selected from halogen, cyano, —COOR wherein R is alkyl or aryl, —$CONH_2$, —S—$C_6H_5$, —S—$COCH_3$, —$OCOC_2H_5$, carbonyl, alkenyl where the double bond is not conjugated with the nitroxide moiety or alkyl of 1 to 15 carbon atoms. $R_5$ and $R_6$ may also form a ring of 4 carbon atoms or 5 carbon atoms and up to two heteroatoms, such as O, N or S by $R_5$ and $R_6$ together. Examples of suitable compounds having the structure above and in which $R_5$ and $R_6$ form part of the ring are pyrrolidin-1-oxys, piperidinyl-1-oxys, the morpholines and pierazines. Particular examples wherein the $R_5$ and $R_6$ above form part of a ring are 4-hydroxy-2,2,6,6-tetramethyl-piperindino-1-oxy, 2,2,6,6-tetramethyl-piperidino-1-oxy, 4-oxo-2,2,6,6-tetramethyl-piperidino-1-oxy and pyrrolin-1-oxyl. In some embodiments, suitable $R_5$ and $R_6$ groups are individually selected from methyl, ethyl, and propyl groups.

Another example of a suitable nitroxide radical may include, but is not limited to, a nitroxide radical having the structure of a six-member ring of Formula (2) as follows:

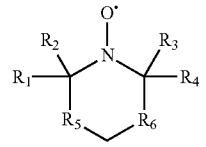

(2)

wherein $R_1$, $R_2$, $R_3$, and $R_4$ are individually selected from alkyl groups or hetero atom substituted alkyl, and wherein $R_5$ and $R_6$ are individually selected from —CR'R'—, wherein each R' is individually selected from hydrogen, a hydroxide group, an alkyl group, or an alkoxy group. The alkyl (or heteroatom substituted) groups $R_1$, $R_2$, $R_3$, and $R_4$ may be the same or different and, in some embodiments, include 1 carbon atom to 15 carbon atoms. In some embodiments, $R_1$, $R_2$, $R_3$, and $R_4$ are individually selected from methyl, ethyl, or propyl groups. In some embodiments, each R' may be the same or different and, in some embodiments, include 1 carbon atom to 15 carbon atoms. In some embodiments, each R' is individually selected from methyl, ethyl, or propyl groups.

An example of a suitable hydroxide of Formula (2) includes 2,2,6,6-tetramethyl-1-piperidinyloxy free radical, commonly referred to as TEMPO, which may also be referred to as 2,2,6,6-tetramethyl-piperidino-1-oxy, 2,2,6,6-tetramethylpiperidine 1-oxyl or 2,2,6,6-tetramethylpiperidinyloxy, of Formula (3) as follows:

(3)

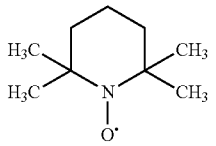

Another example of a suitable nitroxide radical may include, but is not limited to, a nitroxide radical having the structure of a six-member ring of Formula (4) as follows:

(4)

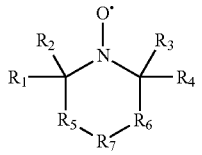

wherein $R_1$, $R_2$, $R_3$, and $R_4$ are individually selected from alkyl groups or hetero atom substituted alkyl, and wherein $R_5$, $R_6$, $R_7$ are individually selected from —CR'R'—, wherein each R' is individually selected from hydrogen, a hydroxide group, an alkyl group, or an alkoxy group. The alkyl (or heteroatom substituted) groups $R_1$, $R_2$, $R_3$, and $R_4$ may be the same or different and, in some embodiments, include 1 carbon atom to 15 carbon atoms. In some embodiments, $R_1$, $R_2$, $R_3$, and $R_4$ are individually selected from methyl, ethyl, or propyl groups. In some embodiments, each R' may be the same or different and, in some embodiments, include 1 carbon atom to 15 carbon atoms. In some embodiments, each R' is individually selected from methyl, ethyl, or propyl groups.

As previously described, the high temperature antioxidant additive comprising the nitroxide radical can be used to improve a liquid fuel composition's thermal oxidative stability. The high temperature antioxidant additive may be included in the liquid fuel composition in any suitable amount as desired for improving thermal oxidative stability. In some embodiments, the high temperature antioxidant composition can be present in the liquid fuel composition in an amount ranging from about 0.1 parts per million ("ppm") to about 500 ppm and, more particularly, ranging from about 1 ppm to about 100 ppm. In some embodiments, the high temperature antioxidant additive may be present in the liquid fuel composition in an amount of about 0.1 ppm, about 0.5 ppm, about 1 ppm, about 5 ppm, about 10 ppm, about 25 ppm, about 50 ppm, about 100 ppm, about 200 ppm, about 300 ppm, about 400 ppm, or about 500 ppm. One of ordinary skill in the art with the benefit of this disclosure should be able to select an appropriate amount of the high temperature antioxidant additive based on a number of factors, including, but not limited to, fuel system operating conditions, the particular nitroxide radical used, and the liquid fuel's hydrocarbon components, among others.

In some embodiments, the high temperature antioxidant additive comprising the nitroxide radical may be included in a liquid fuel composition to extend an oxidation induction period of the liquid fuel composition, which should result in improved thermal stability. The oxidation induction period may be extended as compared to the liquid fuel composition without the high temperature antioxidant additive, for example, from about 10% to 100%, or longer than the fuel without the additive. In some embodiments, the oxidation induction period may be extended as compared to the liquid fuel composition without the high temperature antioxidant additive for period of about 200 seconds, about 500 seconds, about 1,000 seconds, about 2,000 seconds, about 5,000 seconds, about 10,000 seconds, or even longer. The oxidation induction period is an initial slow stage of fuel oxidation after which the oxidation reaction accelerates. As used herein, the oxidation induction period is determined using the PetroOXY automatic oxidation stability tester using a test method developed based on ASTM D 7245. In the test method, a 5 mL sample of the liquid fuel composition is combined with starting oxygen at a pressure of 500 kPa for motor gasoline or 700 kPa for diesel in a small, hermetically seal test chamber and heated to a test temperature. Pressure increases as the temperature of the vessel is increased from the volatilization of the light components of the fuel. Pressure is monitored over time. End of test is where a 10% drop in pressure from the maximum vessel pressure is measured. Tests temperatures are chosen that reflect relevant fuel end use temperatures in fuel systems. It has been determined that the time needed to achieve a pressure drop is directly related to induction period of the fuel composition and, thus, the thermal oxidation stability of the fuel composition. The test temperature for diesel fuel is 200° C. corresponding to a severe condition a fuel would experience in a diesel fuel injector tip. The test temperature for motor gasoline is 155° C. corresponding to a severe condition a fuel would experience in a gasoline fuel injector tip. Lower temperatures were used when the fuel composition was not able to obtain the severe conditions such as in for biodiesel testing.

In some embodiments, the high temperature antioxidant additive may be introduced into a fuel system of an internal combustion engine. In some embodiments, the high temperature antioxidant combination may be combined with the liquid fuel composition in the internal combustion engine. In some embodiments, the high temperature antioxidant composition may be introduced into the internal combustion engine as a component of the liquid fuel composition. In a combustion chamber of the internal combustion engine, the liquid fuel composition may be burned. Suitable internal combustion engines may include, but are not limited to, rotary, turbine, spark ignition, compression ignition, 2-stroke, or 4-stroke engines. In some embodiments, the internal combustion engines include marine diesel engines, aviation piston and turbine engines, aviation supersonic turbine engines, low-load diesel engines, and automobile and truck engines.

In addition to the high temperature antioxidant additive, the liquid fuel composition may further include a liquid fuel. The liquid fuel may include, but are not limited to, motor gasoline, aviation gasoline, marine fuel, and diesel fuel. Combinations of different liquid fuels may also be used. Motor gasoline includes a complex mixture of relatively volatile hydrocarbons blended to form a fuel suitable for use in spark-ignition engines. Motor gasoline, as defined in ASTM Specification D4814, is characterized as having a boiling range of 50° C. to 70° C. at the 10-percent recovery point to 185° C. to 190° C. at the 90-percent recovery point. The diesel fuel can be a petroleum distillate as defined by ASTM specification D975. The aviation turbine fuels can be a petroleum distillate as defined by ASTM specification D1655. The supersonic fuel can be a compound mixture composed primarily of hydrocarbons; including alkanes, cycloalkanes, alkylbenzenes, indanes/tetralins, and naphthalenes. Additional examples of suitable liquid fuels may include, but are not limited to, an alcohol, an ether, a nitroalkane, an ester of a vegetable oil, or combinations thereof. In some embodiments, the nonhydrocarbon fuels may include, but are not limited to, methanol, ethanol, diethyl ether, methyl t-butyl ether, nitromethane, and methyl esters of vegetable oils such as the methyl ester of rapeseed oil. In some embodiments, the liquid fuel may include a mixture of a motor gasoline and ethanol or a mixture of a diesel fuel and a biodiesel fuel, such as an ester of a vegetable oil. Without being limited by theory, it is believed that the effectiveness of the high temperature antioxidant additive comprising the nitroxide radical may be substantially reduced in certain biodiesels. For example, the high temperature antioxidant additive has shown little to no improvement in certain B100 biodiesels.

The liquid fuel may be present in the liquid fuel composition with the high temperature antioxidant additive in any suitable amount. As previously described, the liquid fuel may include any suitable liquid fuel, including a combination of two or more different fuels. In some embodiments, the liquid fuel may be present in the liquid fuel composition in an amount ranging from 98% to 99.99999% by weight of the liquid fuel composition, from 98% to 99.99999% by weight of the liquid fuel composition, or from 99% to 99.999999% by weight of the liquid fuel composition. One of ordinary skill in the art, with the benefit of this disclosure, should be able to select an appropriate liquid fuel and amount thereof to include in the liquid fuel composition for a particular application.

In some embodiments, additional additives can be included in the liquid fuel composition as desired by one of ordinary skill in the art for a particular application. Examples of these additional additives include, but are not limited to, detergents, rust inhibitors, corrosion inhibitors, lubricants, antifoaming agents, demulsifiers, conductivity improvers, metal deactivators, cold-flow improvers, cetane improvers and fluidizers, among others. One of ordinary skill in the art, with the benefit of this disclosure, should be able to select additional additives and amounts thereof as needed for a particular application.

EXAMPLES

To facilitate a better understanding of the present invention, the following examples of certain aspects of some embodiments are given. In no way should the following examples be read to limit, or define, the entire scope of the invention.

Example 1

TEMPO (2,2,6,6-tetramethyl-1-piperidinyloxy free radical) was added to a motor gasoline in an amount of 10 ppm. The oxidation induction period was then measured for this sample liquid fuel composition using the PetroOXY automatic oxidation stability tester as described above. For comparative purposes, the oxidation induction period for the same motor gasoline was also tested without the addition of the TEMPO and with a comparative additive. The comparative additive was 2,2,6,6-tetramethylpiperidine (commonly referred to as "HALS"). The test temperature was 155° C. The motor gasoline used for this test was a premium gasoline blendstock for oxygenate blending ("PBOB"). The PBOB was free of ethanol.

Figure 2:
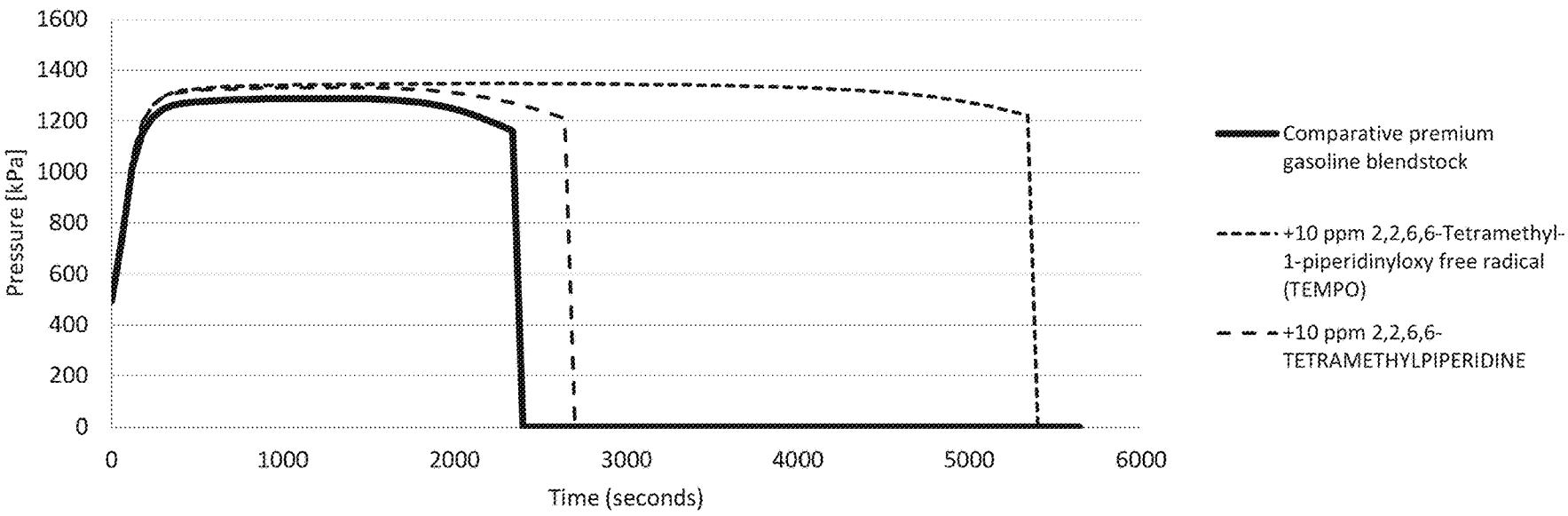
FIG. 2 is a chart showing the oxidation induction period for a premium motor gasoline blendstock with 10 ppm of a nitroxide radical and the oxidation induction period for comparative samples without the nitroxide radical and with an alternative additive.

FIG. 2 is a chart showing the oxidation induction period for these tests. As illustrated, the addition of 10 ppm TEMPO extended the oxidation induction period for the PBOB by more than 2,000 seconds. Indeed, the addition of TEMPO extended the oxidation induction period by approximately 130%. While the comparative 2,2,6,6-tetramethylpiperidine extended the oxidation induction period for the premium motor gasoline, the improvement was approximately 13% as compared to the approximately 130% improvement for TEMPO. The point where there is a precipitous drop in the trace highlights the end of tests and the time where the pressure drop=10% from its maximum value. Extending this point to zero pressure in the trace helps delineate the end point in the data where the no further data was collected and the heating to the sample was discontinued.

Example 2

Additional testing was performed to further evaluate TEMPO's impact on a different liquid fuel's thermal stability in comparison to other additives. In these additional tests, 10 ppm TEMPO was added to a premium motor gasoline with 10 vol % ethanol. The oxidation induction period was then measured for this sample liquid fuel composition using the PetroOXY automatic oxidation stability tester as described above. For comparative purposes, the oxidation induction period for the same liquid fuel was also tested without the addition of the TEMPO and with the addition of a comparative antioxidant additive. The comparative antioxidant additive was N, N'-Disec-butyl-p-phenylenediamine. The test temperature was 155° C. The premium motor gasoline (commonly referred to as "E10") contained 10 vol. % ethanol and had an octane rating of 92.

Figure 3:
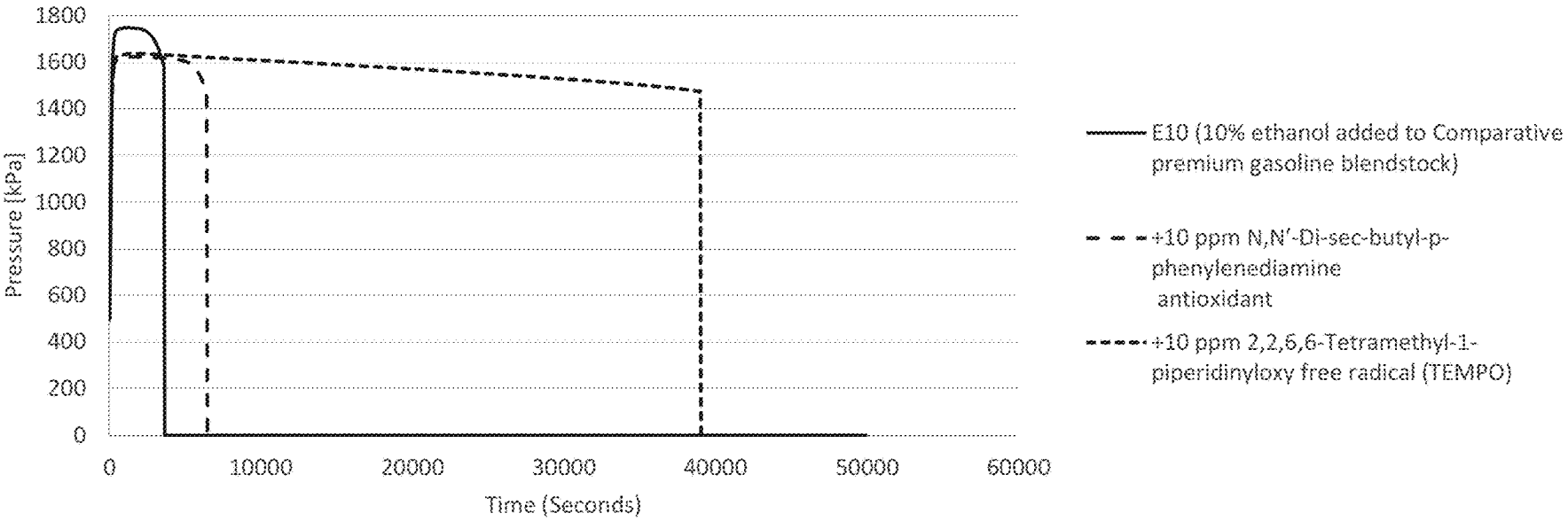
FIG. 3 is a chart showing the oxidation induction period for a premium motor gasoline blendstock with 10 vol. % ethanol and 10 ppm of a nitroxide radical and the oxidation induction period for comparative samples without the nitroxide radical and with an alternative additive.

FIG. 3 is a chart showing the oxidation induction period for these tests. As illustrated, the addition of 10 ppm TEMPO extended the oxidation induction period for the premium motor gasoline with ethanol. Indeed, the oxidation induction period for the sample liquid composition with 10 ppm TEMPO was about 10 times greater (approximately 980% improvement) than the comparative testes without TEMPO or the comparative antioxidant. While the comparative N, N'-Disec-butyl-p-phenylenediamine antioxidant additive extended the oxidation induction period for the premium motor gasoline, the improvement was approximately 80% as compared to the approximately 980% improvement for TEMPO.

Example 3

Additional testing was performed to further evaluate TEMPO's effectiveness in combination with conventional detergents. In these additional tests, 13.6 ppm TEMPO was added to a premium motor gasoline that included 259 ppm of various detergent packages. The oxidation induction period was then measured for these sample liquid fuel compositions using the PetroOXY automatic oxidation stability tester as described above. For comparative purposes, the oxidation induction period for the same liquid fuel was also tested without the addition of the TEMPO and with addition the 300 ppm of the same detergent packages. The test temperature was 155° C.

Figure 4:
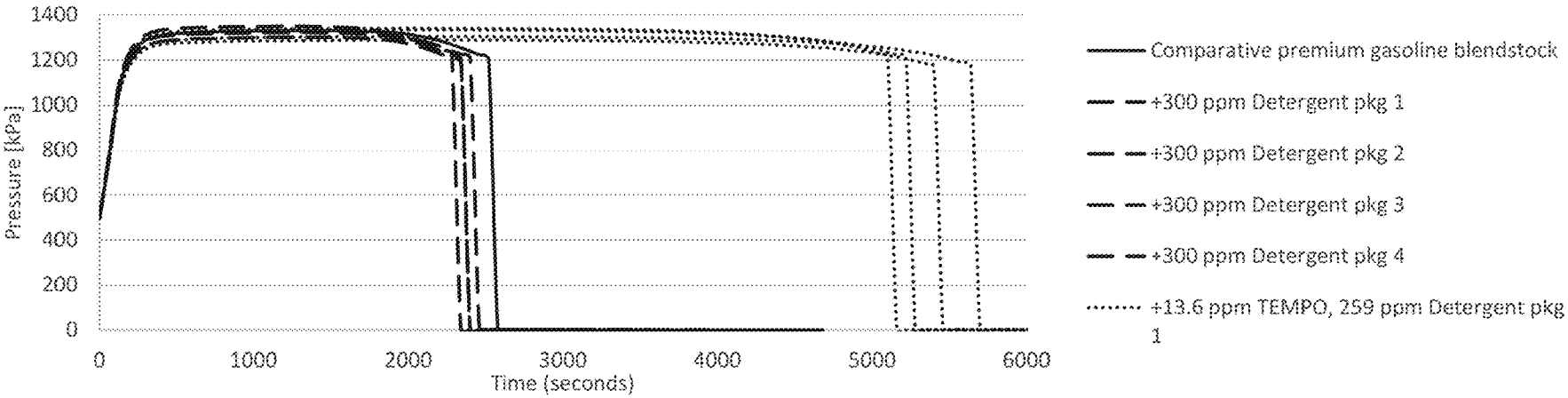
FIG. 4 is a chart showing the oxidation induction period for a premium motor gasoline blendstock with 10 ppm of a nitroxide radical and detergents and the oxidation induction period for comparative samples without the nitroxide radical and without detergent.

FIG. 4 is a chart showing the oxidation induction period for these tests. As illustrated, the addition of TEMPO extended the oxidation induction period for the premium motor gasoline, even in combination with the detergent packages. Indeed, the oxidation induction period for the sample liquid compositions with TEMPO was more than double the oxidation induction period for the comparative tests, thus showing that TEMPO functioned independent of the detergent packages, which is similar to the response when the detergents were absent indicating that the two types of additives are compatible.

Example 4

To further evaluate TEMPO's impact on a liquid fuel's thermal stability, additional testing was performed by adding TEMPO to another motor gasoline in the amount of 10 ppm. The oxidation induction period was then measured for this sample liquid fuel composition using the PetroOXY automatic oxidation stability tester as described above. For comparative purposes, the oxidation induction period for the same motor gasoline was also tested without the addition of the TEMPO. The test temperature was 155° C. The motor gasoline used for this test was a reformulated gasoline blendstock for oxygenate blending ("RBOB"). The RBOB was free of ethanol.

Figure 5:
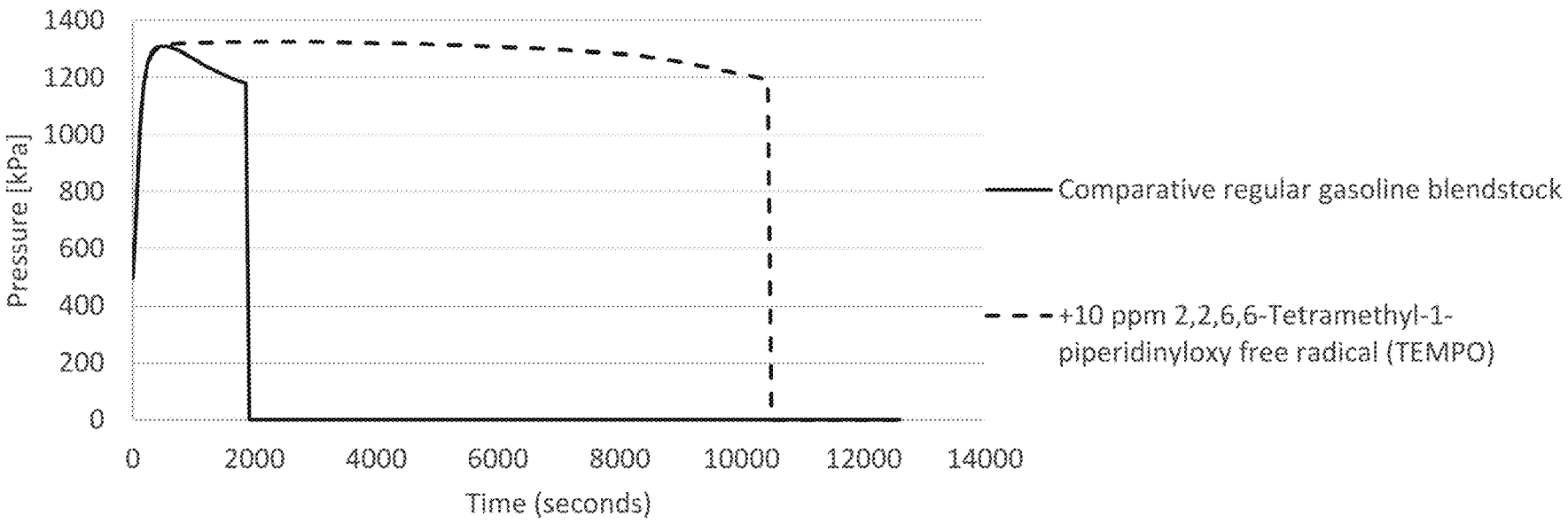
FIG. 5 is a chart showing the oxidation induction period for a regular motor gasoline blendstock with 10 ppm of a nitroxide radical and the oxidation induction period for comparative samples without the nitroxide radical.

FIG. 5 is a chart showing the oxidation induction period for these tests. As illustrated, the addition of 10 ppm TEMPO extended the oxidation induction period for the RBOB as compared to the RBOB without TEMPO. Indeed, the oxidation induction period for the sample liquid compositions with 10 ppm TEMPO was more than 4 times (approximately 460% improvement) the oxidation induction period for the comparative test.

Example 5

To evaluate concentration dependence of TEMPO on a liquid fuel's thermal stability, additional testing was performed by adding TEMPO to a motor gasoline in varying concentrations. The oxidation induction period was then measured for this sample liquid fuel composition using the PetroOXY automatic oxidation stability tester as described above. For comparative purposes, the oxidation induction period for the same motor gasoline was also tested without the addition of the TEMPO. The test temperature was 155° C. The motor gasoline used for this test was a reformulated gasoline blendstock for oxygenate blending ("RBOB"). The RBOB was free of ethanol. The concentrations of TEMPO tested were 10 ppm and 100 ppm of the liquid fuel.

Figure 6:
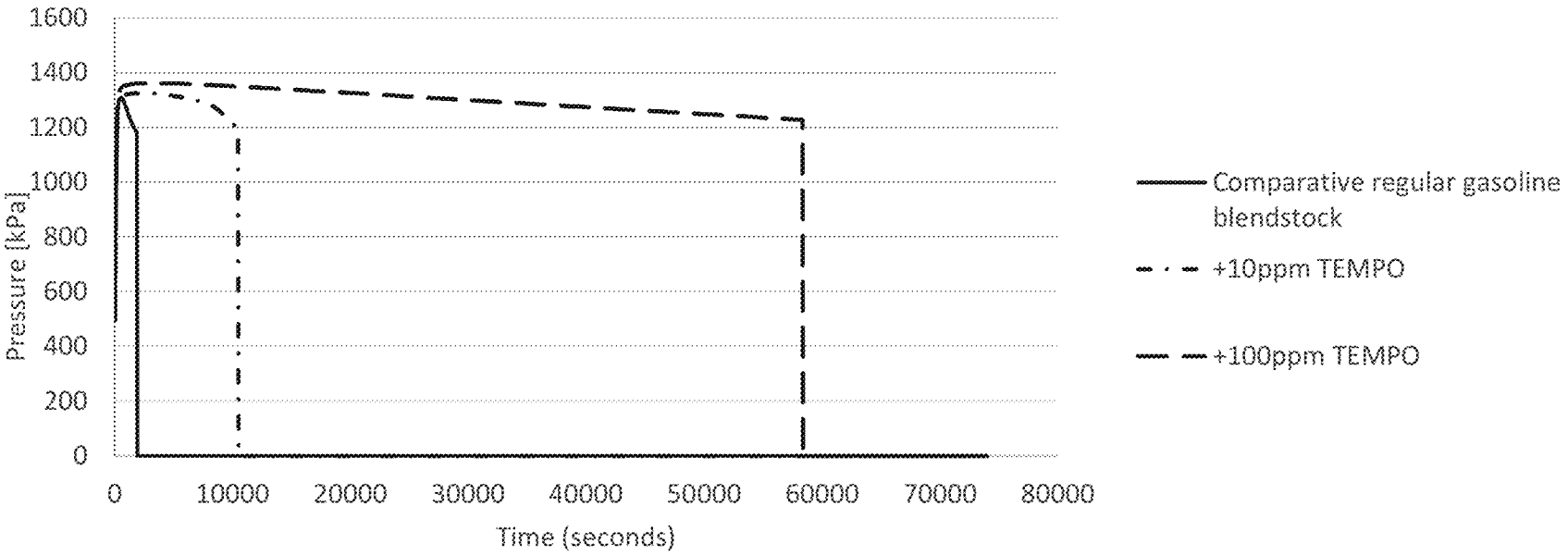
FIG. 6 is a chart showing the oxidation induction period for a regular motor gasoline blendstock with varying concentrations a nitroxide radical and the oxidation induction period for comparative samples without the nitroxide radical.

FIG. 6 is a chart showing the oxidation induction period for these tests. As illustrated, the addition of TEMPO extended the oxidation induction period for the RBOB as compared to the RBOB without TEMPO. In addition, the tests indicate that increasing concentrations of TEMPO provide improved performance with 100 ppm of TEMPO providing an oxidation induction period that was more than 4 times the oxidation induction period for 10 ppm of TEMPO.

Example 6

Additional testing was performed to further evaluate TEMPO's impact on a different liquid fuel's thermal stability in comparison to other additives. In these additional tests, TEMPO was added to a diesel fuel in amount of 10 ppm. The oxidation induction period was then measured for this sample liquid fuel composition using the PetroOXY automatic oxidation stability tester as described above. For comparative purposes, the oxidation induction period for the same diesel fuel also tested without the addition of the TEMPO and with addition of 10 ppm of a comparative antioxidant additive. The comparative antioxidant additive was a phenylene diamine antioxidant, available from Innospec, Inc. as AO-22 fuel antioxidant. The test temperature was 200° C. The diesel fuel was a conventional diesel fuel without any biodiesel, commonly referred to as BO diesel fuel.

Figure 7:
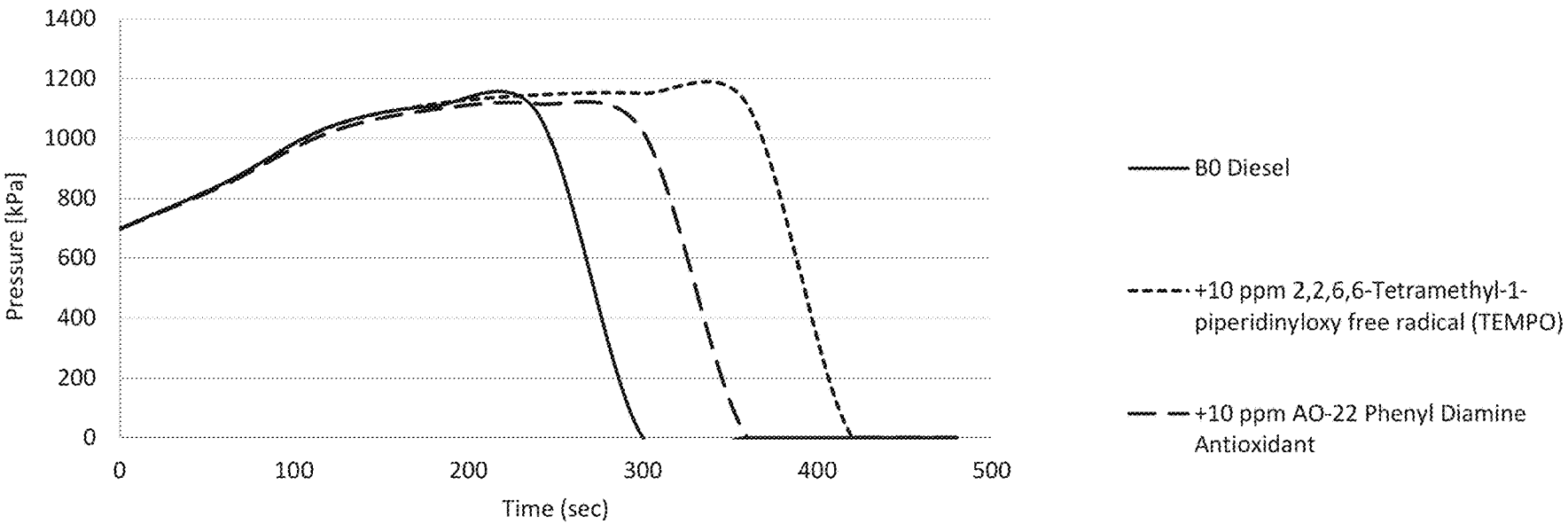
FIG. 7 is a chart showing the oxidation induction period for a diesel fuel with 10 ppm of a nitroxide radical and the oxidation induction period for comparative samples without the nitroxide radical and with an alternative additive.

FIG. 7 is a chart showing the oxidation induction for the tests. As illustrated, the addition of 10 ppm TEMPO extended the oxidation induction period for the diesel fuel. Indeed, the oxidation induction period for the sample liquid compositions with 10 ppm TEMPO provided improved thermal oxidative stability as compared to the comparative phenylene diamine antioxidant.

Example 7

Additional testing was performed to further evaluate TEMPO's impact on different liquid fuels' thermal stability. In these additional tests, TEMPO was added to a diesel fuel in an amount of 10 ppm. The oxidation induction period was then measured for this sample liquid fuel composition using the PetroOXY automatic oxidation stability tester as described above. For comparative purposes, the oxidation induction period for the same diesel fuel was also tested without the addition of the TEMPO. The diesel fuel was a blend of conventional diesel fuel with up to 2% biodiesel, commonly referred to as B2 diesel fuel. The test temperature was 170° C. It should be noted that the test temperature was 170° C. instead of the 200° C. for conventional diesel fuel since the fuel contained up to 2% biodiesel.

Figure 8:
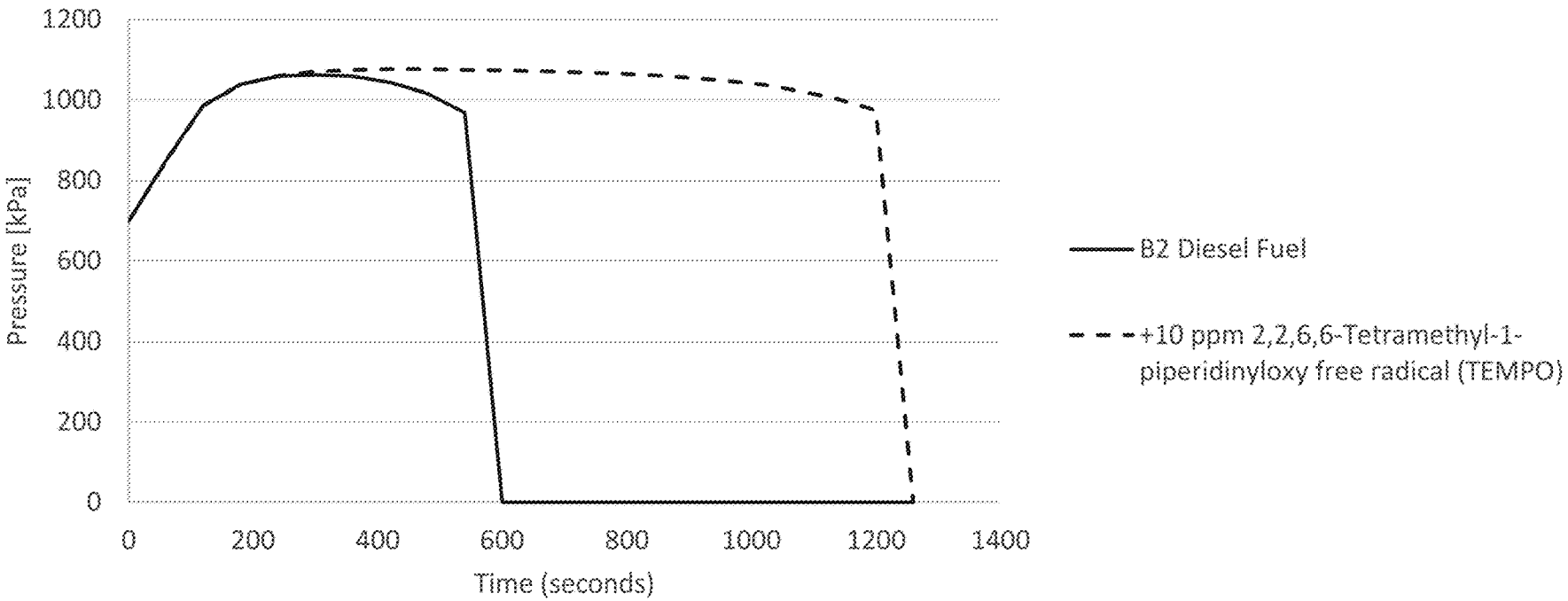
FIG. 8 is a chart showing the oxidation induction period for a B2 diesel fuel with 10 ppm of a nitroxide radical and the oxidation induction period for comparative samples without the nitroxide radical.

FIG. 8 is a chart showing the oxidation induction period for the tests with the B2 diesel fuel. As illustrated, the addition of 10 ppm TEMPO extended the oxidation induction period for the B2 diesel fuel. Indeed, the oxidation induction period for the sample liquid compositions with 10 ppm TEMPO was more than double (approximately 120% improvement) the oxidation induction period for the comparative test.

Example 8

Additional testing was performed to evaluate TEMPO in modern gasoline engine direct injectors. The testing used a custom benchtop heating assembly that included an aluminum heating block with multiple gasoline direct injectors mounted inside as set forth in the table below:

TABLE 1

| Position | Injector Type |
|---|---|
| 1 | Engine OEM A-Injector Manufacturer A |
| 2 | Engine OEM B-Injector Manufacturer A |
| 3 | Engine OEM A-Injector Manufacturer B |
| 4 | Engine OEM C-Injector Manufacturer C |
| 5 | Engine OEM D-Injector Manufacturer C |
| 6 | Engine OEM B-Injector Manufacturer D |
| 7 | Engine OEM A-Injector Manufacturer A |

The injectors were flow tested before and after a thermal stressing cycle. During heat ageing for 30 hours, the aluminum heating block was maintained at a set temperature (170° C. at 100 bar) while the injectors alternated between a brief discharge (15 seconds) and long heat soak periods (30 minutes). The sample fuel composition used in the testing comprised 10 ppm TEMPO in a motor gasoline. For comparative purposes, the same motor gasoline was also tested without the addition of TEMPO.

Figure 9:
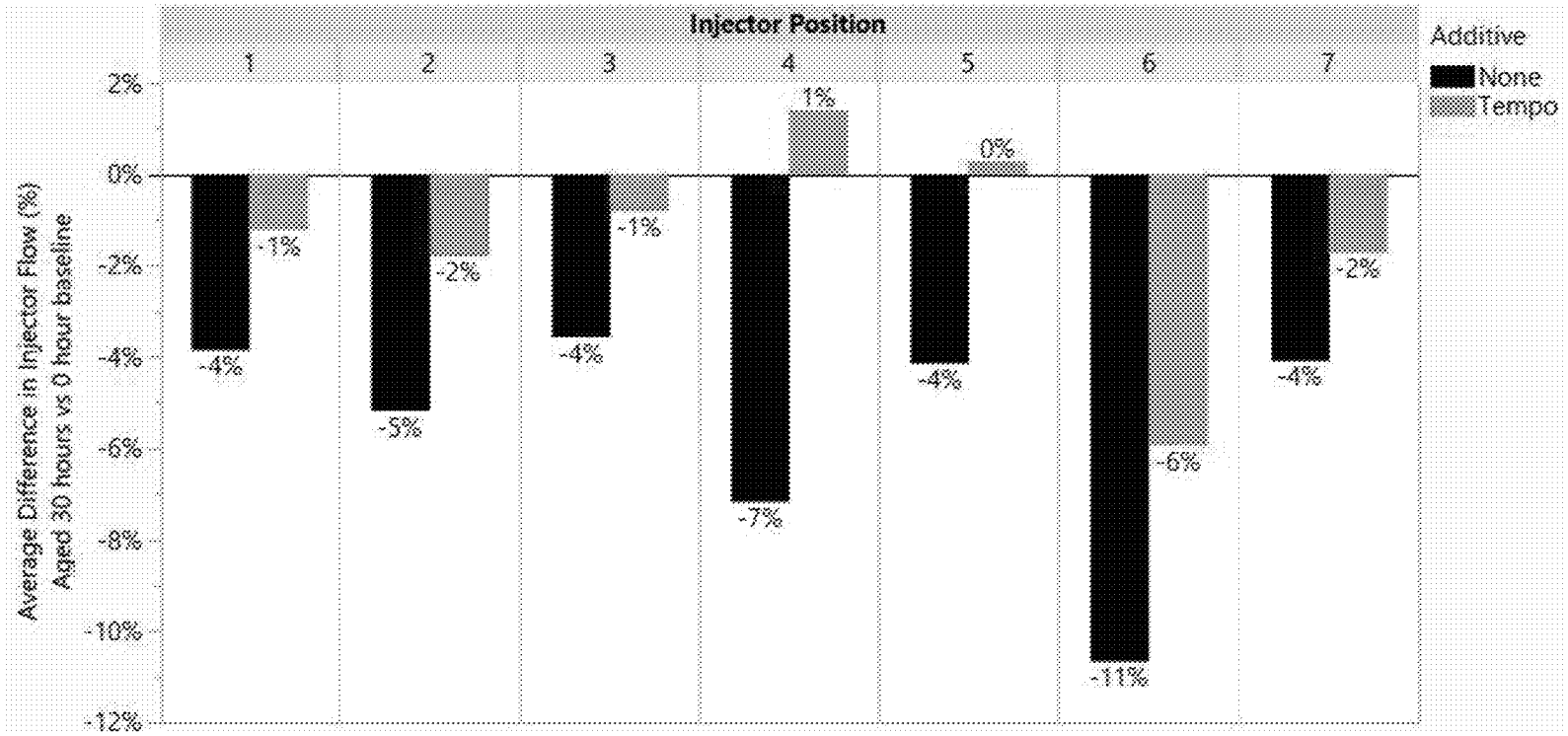
FIG. 9 is a charting showing average difference in injector flow rate for various gasoline fuel injectors tested with 10 ppm of nitroxide radical and a comparative sample without the nitroxide radical.

FIG. 9 is a chart showing the results of the testing. As illustrated, the inclusion of the TEMPO improved fuel flow at estimated operating temperatures for all seven gasoline direct injectors. It should be noted that the injector at position #6 regularly gives varied results, presumably due to its longer length which leads to interference of the fuel release at the nozzle tip. However, the results for the injector at position #6 in this test are similar to the results for the other injectors.

Example 9

Additional testing was performed to further evaluate TEMPO's impact on a liquid fuel's thermal stability. In these tests, thin film oxidation was assessed using intake valve component testing. Thin film oxidation describes a more rapid reaction than the preceding tests in which a small amount of fuel in a thin film is exposed to elevated temperatures and oxygen. Under these conditions, hydrocarbons decompose much more quickly and the oxidation products formed at the fuel-metal interface can rapidly build up on the metal surface, leading to the formation of varnish or deposits. The intake valve component testing was performed in accordance with a test described in SAE Paper 972838 entitled "A laboratory-scale tests to predict IVD," dated Oct. 13-16, 1997. These tests were performed using TEMPO in an amount of either 10 ppm or 20 ppm in a PBOB. The PBOB was free of ethanol. Comparative testing was also performed using the PBOB without the addition of TEMPO. The tests were performed at specimen/chamber temperatures of 240° C. and 265° C. The results of the tests are provided in the table below.

TABLE 2

| | Specimen/Chamber Temperature (° C.) | |
|---|---|---|
| | 240 | 265 |
| | Deposit Weight (mg) | |
| Comparative Premium blendstock | 16.1 | 16.9 |
| +10 ppm TEMPO | 11.2 | 14.3 |
| +20 ppm TEMPO | 8.6 | — |

As illustrated, the addition of TEMPO reduced the amount of deposits on the valves as compared to the same fuel without the addition of TEMPO. This result was improved with an increase in the concentration of the TEMPO.

While the invention has been described with respect to a number of embodiments and examples, those skilled in the art, having benefit of this disclosure, will appreciate that other embodiments can be devised which do not depart from the scope and spirit of the invention as disclosed herein. Although individual embodiments are discussed, the invention covers all combinations of all those embodiments.

While compositions, methods, and processes are described herein in terms of "comprising," "containing," "having," or "including" various components or steps, the compositions and methods can also "consist essentially of" or "consist of" the various components and steps. The phrases, unless otherwise specified, "consists essentially of" and "consisting essentially of" do not exclude the presence of other steps, elements, or materials, whether or not, specifically mentioned in this specification, so long as such steps, elements, or materials, do not affect the basic and novel characteristics of the invention, additionally, they do not exclude impurities and variances normally associated with the elements and materials used.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited.

The invention claimed is:

1. A liquid fuel composition comprising:

a mixture of a motor gasoline and ethanol; and a high temperature antioxidant additive comprising a nitroxide radical having a formula:

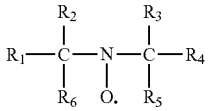

wherein $R_1$, $R_2$, $R_3$, and $R_4$ are individually selected from an alkyl group or a hetero atom substituted alkyl group, and wherein $R_5$ and $R_6$ are any atom or group except hydrogen which can bond covalently to carbon wherein the high temperature antioxidant additive is present in an amount ranging from about 0.1 ppm to about 15 ppm.

2. The liquid fuel composition of claim 1, wherein the gasoline comprises at least one hydrocarbon fuel selected from the group consisting of a motor gasoline, an aviation gasoline, and combinations thereof.

3. The liquid fuel composition of claim 1, wherein the gasoline is present in an amount of about 98 vol. % or greater.

4. The liquid fuel composition of claim 1, wherein $R_1$, $R_2$, $R_3$, and $R_4$ are individually selected from a methyl group, an ethyl group, or a propyl group, and wherein $R_5$ and $R_6$ form part of a ring of 4 carbon atoms or 5 carbon atoms.

5. The liquid fuel composition of claim 1, wherein $R_5$ and $R_6$ are individually selected from halogen, cyano, —COOR wherein R is alkyl or aryl, —$CONH_2$, —S—$C_6H_5$, —S—$COCH_3$, —$OCOC_2H_5$, carbonyl, alkenyl where the double bond is not conjugated with the nitroxide moiety, or an alkyl of 1 to 15 carbon atoms.

6. The liquid fuel composition of claim 1, wherein the nitroxide radical has a formula:

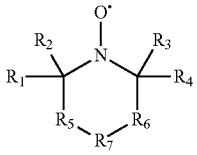

wherein $R_5$, $R_6$, and $R_7$ are individually selected from —CR'R'—, wherein each R' is individually selected from hydrogen, a hydroxide group, an alkyl group, or an alkoxy group.

7. The liquid fuel composition of claim 6, wherein $R_1$, $R_2$, $R_3$, and $R_4$ are individually selected from a methyl group, an ethyl group, or a propyl group.

8. The liquid fuel composition of claim 1, wherein the nitroxide radical comprises 2,2,6,6-tetramethyl-1-piperidinyloxy free radical.

9. The liquid fuel composition of claim 1, wherein the liquid fuel is present in an amount of about 99 vol. % or greater, and wherein the high temperature antioxidant additive is present in an amount ranging from about 1 ppm to about 15 ppm.

10. The liquid fuel composition of claim 1, further comprising at least one additional additive selected from the group consisting of a detergent, a rust inhibitor, a corrosion inhibitor, a lubricant, an antifoaming agent, a demulsifier, a conductivity improver, a metal deactivator, a cold-flow improver, a cetane improvers, fluidizer, and combinations thereof.

11. A liquid fuel composition comprising:

a gasoline in an amount of about 98 vol. % or greater, wherein the gasoline comprises a motor gasoline and ethanol; and a nitroxide radical in an amount ranging from about 1 ppm to about 15 ppm and having a formula:

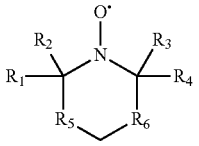

wherein $R_1$, $R_2$, $R_3$, and $R_4$ are each a methyl group, and wherein $R_5$ and $R_6$ are individually selected from —CR'R'—, wherein each R' is hydrogen.

12. A method for improving thermal oxidative stability of a liquid fuel, comprising:

including an antioxidant additive comprising nitroxide radical in the liquid fuel, wherein the nitroxide radical has a formula:

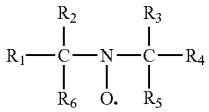

wherein $R_1$, $R_2$, $R_3$, and $R_4$ are individually selected from an alkyl group or a hetero atom substituted alkyl, and wherein $R_5$ and $R_6$ are any atom or group except hydrogen which can bond covalently to carbon, wherein the liquid fuel comprises a mixture of a motor gasoline and ethanol wherein the high temperature antioxidant additive is present in an amount ranging from about 0.1 ppm to about 15 ppm.

13. The method of claim 12, wherein $R_1$, $R_2$, $R_3$, and $R_4$ are individually selected from a methyl group, an ethyl group, or a propyl group, and wherein $R_5$ and $R_6$ form part of a ring of 4 carbon atoms or 5 carbon atoms.

14. The method of claim 12, wherein the nitroxide radical has a formula:

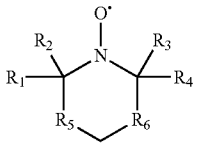

wherein $R_5$ and $R_6$ are individually selected from —CR'R'—, and wherein each R' is individually selected from hydrogen, a hydroxide group, an alkyl group, or an alkoxy group.

15. The method of claim 12, wherein the nitroxide radical comprises 2,2,6,6-tetramethyl-1-piperidinyloxy free radical.

* * * * *